US006392346B1

(12) United States Patent
Newell et al.

(10) Patent No.: US 6,392,346 B1
(45) Date of Patent: May 21, 2002

(54) CHEMICAL COMPOSITION FOR MERCURY FREE METAL HALIDE LAMP

(75) Inventors: P. Bruce Newell, Carlisle; Nanu Brates, Malden; Richard A. Snellgrove, Danvers, all of MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/413,922

(22) Filed: Oct. 7, 1999

Related U.S. Application Data

(60) Provisional application No. 60/129,195, filed on Apr. 14, 1999.

(51) Int. Cl.[7] ..... H01J 17/20; H01J 61/12; H01J 61/18

(52) U.S. Cl. ..... 313/637; 313/638; 313/643; 313/634; 313/636; 313/553

(58) Field of Search ..... 313/549, 631, 313/632, 634, 635, 636, 637, 638, 643, 17, 25, 26, 553, 623, 624, 640; 315/248, 246, 363

(56) References Cited

U.S. PATENT DOCUMENTS 3,947,714 A * 3/1976 Rehder et al. ..... 313/638
4,757,236 A * 7/1988 Dakin et al. ..... 313/638
5,153,482 A * 10/1992 Keijser et al. ..... 313/634
5,256,940 A * 10/1993 Wada et al. ..... 313/640 X
5,973,453 A * 10/1999 Van Vliet et al. ..... 313/623
6,005,346 A * 12/1999 Shaffner ..... 313/637
6,069,456 A * 5/2000 Fromm et al. ..... 315/248
6,137,230 A * 10/2000 Born et al. ..... 313/638

FOREIGN PATENT DOCUMENTS

WO WO9825294 6/1998 ..... H01J/61/02
WO WO9905699 4/1999 ..... H01J/61/22

* cited by examiner

*Primary Examiner*—Vip Patel
*Assistant Examiner*—Mack Haynes
(74) *Attorney, Agent, or Firm*—William H. McNeill

(57) ABSTRACT

Rare-earth halides are shown to be a replacement for scandium halides in mercury-free discharge arc lamps if modifications are made to the prior art lamp design and operating temperatures. The inventive chemical compositions of the discharge medium provide enhanced color rendition index values. In addition, it has been unexpectedly determined that during the operation of the discharge lamps, the rare earth iodides do not react significantly with the fused silica arc tube. Equally as significant, any free iodine, which is so formed, has minimal impact on the efficacy of the lamp compared to the conventional scandium iodide lamps. Therefore, the rare earth iodide-containing lamps provide longer lifetime with superior illumination characteristics than conventional discharge lamps.

7 Claims, 1 Drawing Sheet

CHEMICAL COMPOSITION FOR MERCURY FREE METAL HALIDE LAMP

This application claims priority from Provisional Application No. 60/129,195, filed Apr. 14, 1999.

FIELD OF INVENTION

This invention relates to mercury-free metal halide arc discharge lamps, and, more particularly to the use of rare earth iodides as a replacement for scandium iodide in low-wattage, mercury-free arc discharge lamps in order to provide improved photometric and electrical characteristics.

BACKGROUND OF THE INVENTION

The metal halide lamp is an improvement to the mercury lamp. In addition to mercury and noble gas, the lamp also contains salts of elements that emit desired radiation. Designers specify metal halide lamps in high power applications such as streetlights and high bay illumination. But more and more metal halides are being designed for lower power applications as lamp and system technology improves.

Sodium/scandium chemistry is well known as an emitter of visible light. Indeed, it is the preferred chemistry for most of the metal halide type of lamps manufactured for general illumination in the United States today. Its primary asset is initial efficacy. With sodium/scandium chemistry, the larger lamp types easily produce over 100 lumens per watt (LPW). Another advantage is the correlated color temperature (CCT). A range of CCT from 3000 Kelvin to 5000 Kelvin is readily obtained by varying the sodium to scandium ratio.

The disadvantage of this system, however, is a poor color rendering index (CRI). Typically, sodium/scandium lamps produce light with a CRI of only 65 Ra. Although this value allows their use for street lighting in the United States, other countries, especially in Europe, prefer significantly higher CRI values.

A more serious disadvantage of the sodium/scandium chemistry arises from the reaction of the scandium with the silica in the envelope wall. This reaction progresses more rapidly above approximately 800° C. Unfortunately, for standard mercury-metal halide lamps, this is below the temperature at which significant vaporization of the chemicals occurs and the temperature at which the lamp would begin to produce extraordinary performance characteristics. Consequently, lamp engineers sacrifice some performance in order to keep the temperature low and prolong life.

One of the reaction products is scandium silicate; the other is excess free-iodine. Excess free iodine reduces the efficacy of the sodium/scandium lamps; it increases the required voltage, and affects the CCT and the CRI. In sodium/scandium lamps containing mercury, the scandium-silica reaction with the ensuing excess free iodine contributes to early lumen maintenance failure, a major problem with commercially available sodium/scandium metal halides. In mercury-free lamps, the free iodine not only reduces the efficacy of the lamp but constricts the arc, thus raising the lamp voltage and increasing the "crest factor", or re-ignition voltage.

In addition to the desire to avoid the problems of sodium/scandium lamp chemistry and to improve inherent lamp characteristics such as CCT, and CRI, and to improve efficacies, there are concomitant desires to reduce manufacturing costs, and to eliminate toxic materials from the metal halide discharge lamps. In this regard there is much effort to eliminate mercury from the lamp chemistry.

The removal of mercury from arc lamps is not an easy goal since mercury is an ideal arc medium. It is a liquid with a low vapor pressure at room temperature. Thus, it is easy to strike and sustain an arc. At operating temperatures, however, the mercury is completely vaporized and the pressure becomes quite high. The voltage across the lamp increases to the point where cost effective, efficient power supplies can be designed to drive the lamp.

Several metal halide lamp technologies do not use mercury in the arc tube. However, previous attempts at mercury-free lighting systems have been plagued with poor efficiency, poor color, poor life, and have been restricted to horizontal operating conditions. One such technology uses an arc discharge tube without electrodes and is driven by microwave or radio frequency energy. This technology requires a microwave source and a means to couple the energy to the arc tube. Generally, the arc tube must be in close proximity to the wave-guides used as the means of coupling.

Another mercury-free metal halide technology uses a pulsed ballast source to operate the arc discharge tube. This technology requires an arc tube with electrodes at opposing ends and a power source that generates narrow pulses across the anode and cathode. Light is emitted during the pulse phase; so the power supply must generate repetitive pulse to achieve the perception of constant light. One patent describing this technology is U.S. Pat. No. 4,874,988 issued Oct. 17, 1989 and assigned to the assignee of the instant invention.

Another mercury-free technology is taught in U.S. Pat. No. 4,757,236 which teaches a mercury-free sodium lamp using an alumina arc tube and xenon buffer gas to achieve high luminous efficiency. The patent does not teach or suggest any arc tube materials other than alumina. This patent also teaches using high xenon pressure as a buffer gas to achieve reduced wall reactions. It describes the need for additional starting requirements for such a design. This patent also discloses a second metal halide in combination with sodium iodide.

The present invention addresses the deficiencies discussed hereinabove. Apparent to those skilled in the art is that many of these parameters are dependent on one another or related to yet other variables. In some cases the parameters may actually be inversely related. Therefore, it has been very difficult to create a system for all characteristics. In these cases, improving even one parameter while not degrading any others is a significant step forward in the art.

DISCLOSURE OF THE INVENTION

It is, therefore, an object of the invention to obviate the disadvantages of the prior art.

Yet another object is to provide a discharge arc lamp with improved color rendition index values.

Another object of the present invention is to provide an arc medium composition that is less reactive with the arc tube and the electrodes.

Still another object of the current invention is to provide a discharge arc lamp with a color temperature and color rendition index that remain constant over the life of the lamp.

Yet another object of the current invention is to provide a discharge arc lamp whose efficacy, measured in lumens per watt, degrades little over the lifetime of the lamp.

Additionally, an object of the instant invention is to provide a discharge arc lamp that is more environmentally acceptable by removing mercury from the arc medium.

Furthermore, an object of the invention is to provide a discharge lamp that is unlikely to burst by maintaining a low pressure within the arc discharge tube.

Yet another object of the present invention is to provide a lamp manufacturing process and arc chemistry that are both inexpensive and reliable.

The present invention is an outcome of the desire to improve upon the known deficiencies of the industry-standard sodium/scandium discharge arc lamp technology. Specifically, it is known that this arc composition suffers from two rather specific deficiencies: a low color rendition index (CRI) value of approximately Ra65; and a composition that is inherently reactive with the glass arc tube. In the former case, the low CRI precludes selling the lamps for certain applications in certain localities, such as in Europe where CRI values must be exceed 80 before commercial success can be achieved. In the latter case, photometric and efficiency characteristics change dramatically over the lifetime of the lamp.

A second desire is to eliminate hazardous and environmentally unacceptable components from the lamp discharge medium. As evidenced from the patents cited supra, the industry has long had the goal of removing mercury from the arc medium. This desire has proved problematic since mercury plays an important part in lamp operation and a beneficial role in lamp photometric quality and overall efficiency. Indeed, studies have shown that the efficiency characteristics of the sodium/scandium are made significantly worse when mercury is removed from the arc medium since operating voltages fall off significantly. In the absence of mercury, lamps become difficult to start and require alternative technologies to compensate for the loss in the voltage gradient. Furthermore, at reasonable amperage, the power into the lamp is insufficient to raise the envelope temperature high enough to vaporize the salts. One method to increase the voltage and the power is by increasing the pressure of a noble gas in the arc medium. However, this makes the lamp difficult, if not impossible to start.

In the present invention, the decrease in voltage gradient caused by the removal of mercury is partially compensated by modifying the aspect ratio of the lamp design (see co-pending application Ser. No. 09/413,923, filed concurrently herewith). The aspect ratio is defined as the distance between the two electrodes in the arc tube divided by the diameter of the arc tube. For acceptable voltage gradients, the aspect ratio should be about 5:1 but values up to 15:1 still provide adequate results. When this lamp design is utilized with the standard sodium/scandium iodide discharge medium, the lamp performs acceptably, except that the CRI values are still unacceptably low. It has now unexpectedly been found that the replacement of scandium iodide with one or more rare earth iodides can still yield acceptable efficacies and can provide for increased CRI values and allow for additional benefits such as stable photometric values during the useful life of the lamp.

BRIEF DESCRIPTION OF THE DRAWINGS

A complete understanding of the present invention may be obtained by reference to the accompanying drawings, when considered in conjunction with the subsequent detailed description, in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

The present invention comprises a combination of modifications to the chemistry of the arc medium and the lamp design. When these changes are performed, a metal halide discharge lamp is obtained that surpasses known current technology. Specifically, the lamp provides light having a color corrected temperature of between 3500 and 4500 K, and a color rendition index greater than 80. Furthermore, the lamp can have an efficacy of more than 100 lumens per watt (LPW). Additionally, the inventive lamps are more stable over their useful lifetime.

Figure 1:
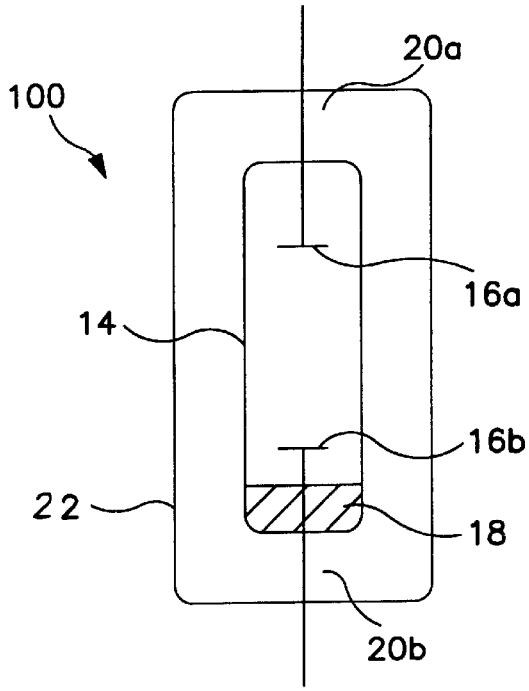
FIG. 1 illustrates a schematic representation of the discharge arc lamp of the present invention.

The discharge arc lamps of the present invention are of similar construction to prior art metal halide lamps except that they require an aspect ratio of between about 5:1 and about 15:1. Refer to FIG. 1 for a schematic representation of arc lamp 100, the first embodiment of the present invention. The electrode 16 composition can be of tungsten. The electrodes 16 are part of a sealed arc tube wall 14 that comprises a glass material. Typically, the glass is a fused silica but other materials may also be acceptable. These include borated silica or polycrystalline alumina. The dimensions of a typical glass arc tube as depicted in FIG. 1 are 80 mm in length from electrode 16*a* to electrode 16*b*, but can vary from about 50 mm to about 150 mm. The diameter of the arc tube lamp 100 typically is 6 mm to 8 mm but can vary from about 5 mm to about 13 mm, so long as the required aspect ratio is maintained.

Figure 2:
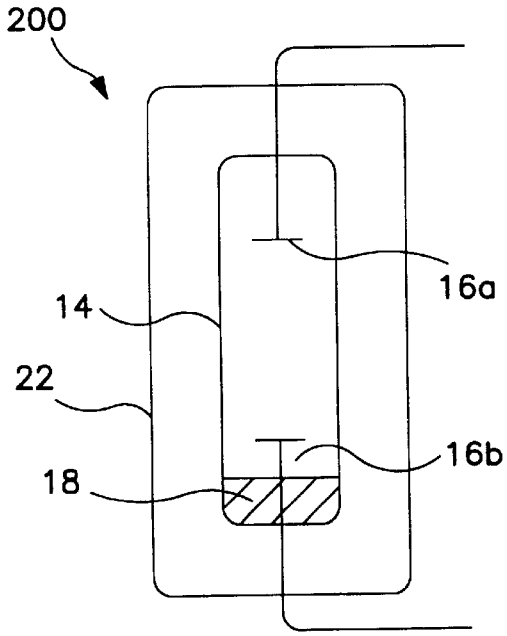
FIG. 2 illustrates a schematic representation of the discharge arc lamp, further containing an outer jacket, of the present invention.

The sealed arc tube lamp 100 comprising the two electrodes 16*a* and 16*b* is optionally enclosed within a second sealed container 22 having electrical leads 20*a* and 20*b* that connect the electrodes 16*a* and 16*b* to an external electrical supply. Referring to FIG. 2 this combination represents a second embodiment of the present invention and is depicted as arc tube lamp 200. The second sealed container 22 can either be evacuated or filled with a gas. In order to prevent loss of heat from the arc tube 14, it is preferred that the second container 22 be evacuated. In general, an evacuated outer jacket or container 22 allows the lamp 200 to have higher efficacy at lower powers. Preferred gases include air, nitrogen, and other gases that have low thermal conductivity values.

The arc medium is contained within the sealed arc tube 14. The medium is composed of a minimum of two components. The first component comprises volatile salts selected from the rare earth halides, alkali metal halides, and thallium iodide. The rare earth halides are defined as the halides of element number 57 to element number 71, namely lanthanum halide through and including lutetium halide. Halide salts are salts comprising anions from Group 7A elements of the Periodic Chart, the most preferred being the iodide ion. The most preferred rare earth halides are dysprosium triiodide, holmium triiodide, thallium triiodide and thulium triiodide. The alkali metal halides are salts comprising Group 1A elements and Group 7A elements. The Group IA elements useful within this invention are lithium, sodium, potassium, rubidium and cesium. The preferred Group 1A elements are lithium, sodium and cesium. The most preferred Group IA element is sodium. The halide salt of the Group 1A element that is most preferred is the iodide. Thallium iodide is included to balance the spectral output.

The weight ratio of these halide salts can be varied to obtain specific color corrected temperatures, but typically the rare earth halides are in a weight ratio of 2 to 3 compared to the alkali metal halides and 1 to 0.75 compared to thallium iodide. Within the mixture of rare earth halides, typically the halides are maintained at equal weights, but ratios between any two rare earth halides can vary from 1 to 3. The halide salts, typically weighing from 5 mg to 40 mg, are added to the arc tube prior to sealing. A preferred amount of total halide salts is approximately 25 mg for an arc tube of dimensions 80 mm by 8 mm. A preferred arc medium composition is where the alkali metal halides comprise sodium iodide and the rare earth halides comprise dyprosium iodide, holmium iodide, thulium iodide, and thallium iodide in the molar ratio of 6:1:1:1:0.76 (Na/Dy/Ho/Tm/Tl) respectively.

To assist in igniting the arc the medium contains a second component. This material is typically an inert buffer gas such as helium, neon, argon, krypton or xenon. Xenon is preferred from among these inert gases because it provides the highest efficacy. However, above a certain pressure the buffer gas increases the starting voltage making the lamp difficult to ignite. For the present invention, the amount of buffer gas is typically less than 500 Torr. It has been observed that between 100 and 300 Torr xenon, efficacy increases only by 1 LPW. This small increase does not warrant the starting difficulties encountered at the higher pressures. The preferred amount of buffer gas is less than 150 Torr and most preferred is less than 50 Torr. For reasons that are at this time not well understood, the optimal amount of xenon for the rare earth/sodium halide mercury-free composition is significantly less than is required for the scandium/sodium halide composition. The benefit of this observation is that lamps of low pressure can be utilized without impacting photometric or electrical properties, while providing lamps that start more easily.

A third component optionally incorporated into the arc medium of the present invention is a getter material. Getters are known in the art to react with or consume unwanted volatile contaminants. In this case a getter can be added to assist in combining with excess free iodine.

Iodine is liberated in the heat at the arc and by reaction with the envelope wall. It is derived from the halide salts. Excess amounts of iodine cause deleterious effects, one in particular being re-ignition voltage. This problem can be so severe that the lamp will self extinguish, at which time the purple color of free, gaseous iodine can be observed in the arc tube. Although the lamp can be re-ignited, this event produces irreversible damage to the lamp, causing a 30% or more loss of efficacy.

In the present invention the getter can combine with the excess iodine and prevent high re-ignition voltage. For prior art scandium/sodium halide lamps getters actually decrease efficacy by up to 30%. By removing the excess iodine, the getter allows scandium to attack the glass wall 14, producing solid scandium silicate and gaseous silicon tetraiodide. The silicon tetraiodide in turn reacts with the electrodes to produce tungsten silicide and more free iodine. The reaction proceeds until all of the getter is completely consumed. Common getters used in prior art discharge arc lamps are scandium, indium, and cesium; all can be utilized in the current invention. Indium is a preferred getter for iodine since it does not react with the glass arc envelope 14. The need for getters in the present invention is less critical than with prior art discharge arc lamps.

The replacement of scandium iodide with the rare earth iodides requires higher envelope temperatures to operate the lamp. For the inventive lamps, envelope temperatures of 9000 to 1100° C. are required due to the lower vapor pressures of rare earth iodides. Below 800° C., very little rare earth chemical reaches the arc stream.

In an experiment, the power to the lamp was increased so that the envelope temperature rose above 1150° C. The lamp suffered irreversible damage. Subsequent operation at 400 watts then revealed that a 35 volt increase in voltage from 105 to 140 volts and a 10 LPW decrease in efficacy from 90 to 80 LPW was observed. Considering the abuse inflicted on the inventive lamp, the degradation observed is small compared to similar prior art scandium/sodium lamps. The lamp exhibited a small area of devitrification extending from 2 cm from the base end electrode. Rare-earth silicate was found in these regions. Rare earth silicates are formed by reaction of the rare-earth iodides, with the fused silica glass.

A second reaction product is iodine. At viable power levels, excess iodine can add 50 to 70 volts to the arc tube drop. With rare-earth chemistries operating at temperatures that produce attractive performance, the iodine is produced by reversible dissociation of the vaporized rare-earth iodide salts. When the lamp cools, the salts recombine. With scandium/sodium chemistries of the prior art lamps, operating at temperatures that also produce attractive performance, the iodine is produced not only by reversible dissociation but also by irreversible reaction of the scandium iodide with the fused silica wall. This produces excess free iodine.

When operated within the range of 300 watts to 500 watts, the arc lamps of the current invention provide the following attractive performance measures: >80 LPW, 4000K CCT. >80 Ra, and >120 volts with essentially no degradation of these values over the lifetime of the lamp. Additionally, the lamps can be restarted repeatedly and yield the same performance.

COMPARATIVE EXAMPLE 1

An arc tube 14 of 8 mm bore diameter and 80 mm length and having two electrodes 16*a* and 16*b* at the opposing ends, was filled with 40 mg of a mixture of iodides comprising 19.6 weight % DyI3, 19.6 weight % HoI3, 19.6 weight % TmI3, 32.2 weight % NaI and 9 weight % TlI3. Additionally, the tube 14 was pressurized with 150 Torr xenon and then sealed. The power was raised to 150 watts, generating an arc tube temperature of below 900° C. Under these conditions the efficacy of lamp 100 was 64 LPW. The CCT ranged upwards from 5200 Kelvin and the CRIs were typically less than 60 Ra.

Working Example 1

The arc lamp 200 with a vacuum jacket 22 as described in Comparative Example 1 was ignited using a power of 330 watts (approximately 4.0 amps). The current was then increased to 4.5 amperes and the voltage stabilized at about 150 volts and 670 watts. The current was then reduced to 3.5 amperes and then finally brought to 4.0 amperes. Upon shutoff and cool down the purple color of iodine was observed in the arc tube and a small streak of "devitrification" extended 2 cm from the base end electrode. The lamp 200 was reignited to a power of 400 watts. The data indicate that the resistance of the lamp had more than doubled from its initial value (22 ohm to 56 ohm). None-the-less, graphs of voltage v power indicated that the lamp had stabilized and yielded repeatable data (at powers less than 400 watts). Prior to shutdown, at 4.0 amps the arc tube temperature ranged from 900° C. at the dome end to 1150° C. over the salt pool 18 at the base end. The lamp exhibited efficacy exceeding 90 LPW prior to running the lamp at 670 watts. This value decreased to 80 LPW afterwards. This degradation (approximately 11%) in efficiency is an improvement over the 30–40% degradation observed when the scandium/sodium medium was tested under similar conditions.

Working Example 2

A similar lamp configuration to that of Working Example 1 was used, except the bore diameter was 7 mm. The lamp chemistry was exactly the same as in Working Example 1. In this series of experiments, the lamp power was maintained below 440 watts (24 watts/cm$^2$) and 3.1 amps. The temperature under these conditions reached 1057° C. under the salt pool at the base end. Similar to the 8 mm bore lamp, the voltage increased rapidly to 175 volts as the current was increased from 3.0 to 3.1 amperes. At this point the temperature of the salt pool 18 increased from 954° C. to 1057° C. The efficacy increased to 99 LPW, and the CRI reached 81 Ra. Upon shutoff and cool down, the purple color of gaseous iodine was observed in the arc tube. Unlike the 8 mm bore lamp in working Example 1, this 7 mm lamp suffered no permanent change in its performance measurements as a result of operating at 440 watts (1057 C.).

Working Example 3

Four lamps 200 as described in Working Example 1 were prepared. Two contained the rare-earth halide medium as described in Working Example 1 while the other two contained the scandium/sodium/cesium halide chemistry having a molar ratio of 1:11:0.03. All lamps contained 40 mg of halides and 150 Torr xenon. One of each chemistry was further doped with 10 mg iodine. The lamps were subjected to a range of power from 200 to about 500 watts and their efficiencies were measured. The rare-earth halide lamps with iodine exhibited an efficacy falloff of approximately 30 LPW compared to type, while the scandium halide lamps exhibited a 50 LPW falloff. The color correction temperatures were also measured. The results show only a small change for the rare-earth pair but for the iodine-containing scandium chemistry the CCT reached temperatures above 7000 K.

Working Example 4

Modeling experiments using the rare-earth chemistry described in Working Example 1 and various bore sizes up to 10 mm bore arc tubes 14 and up to 500 Torr xenon buffer gas were investigated. The results indicate that efficacy approaches 100 LPW at powers of 400 watts. Efficacy decreases with bore size. In these experiments, 7 mm bore emerged as a good design parameter. Efficacy decreases with xenon pressure. The data indicate that 150 Torr xenon is the preferred pressure; however, later experiments indicate that a lower pressure on the order of 50 mm is yet a better choice. Color temperature was 4000 K and the CRI approached 80 Ra at 400 watts, 150 Torr and 7 mm bore size. Under these conditions the voltage was about 100 volts and the original salt pool 18 was about 900° C.

Working Example 5

A series of arc tubes 100 and 200 containing the rare-earth chemistry described in Working Example 1 was prepared. The tubes 14 had bore diameters that ranged from 6 mm to 9 mm and all had an arc length of 80 mm. The dose of the rare-earth and alkali halides was 40 mg and the tubes were xenon filled at 100, 150 and 300 Torr. Half of the tubes 14 were vacuum jacketed 22 to compare them to air cooling. Regression curves were generated to determine the effects of xenon pressure, bore, and operating position (vertical vs horizontal). The lamps 100 and 200 were run at 400 watts. The efficacy of the lamps increased monotonically with power loadings from 10 to 45 watts/cm$^2$ reaching peak efficacies approaching 110 LPW for air cooled samples. The vacuum jacketed lamps 200 were nominally 15% more efficient than the air cooled lamps at the low power loadings (up to 25 watts/cm$^2$) but their efficacies started to roll over at about 20 watts/cm$^2$. This corresponds to a wall temperature above 1000° C. Air cooled lamps that can operate at much higher power loadings at the same temperatures (due to gas conduction and free convection cooling) achieved higher efficacies.

While there have been shown and described what are at present considered the preferred embodiments of the invention, it will be apparent to those skilled in the art that various changes and modifications can be made herein without departing from the scope of the invention as defined by the appended claims.

What is claimed is:

1. A metal halide arc discharge lamp comprising an arc tube of pre-defined diameter, comprising first and second electrodes at opposite ends of said arc tube separated by a pre-defined length, said tube being sealed at said opposite ends to confine an arc generating and sustaining medium, said medium being essentially mercury-free and scandium iodide free and comprising a mixture of alkali metal halides, rare earth halides and an inert buffer gas, wherein said alkali metal halides comprise sodium iodide and said rare earth halides comprise dysprosium iodide, holmium iodide, thulium iodide, and thallium iodide in die molar ratio of 6:1:1:1:0.76 respectively.

2. The discharge lamp as recited in claim 1, wherein said inert buffer gas comprises xenon, argon, and krypton and mixtures thereof.

3. The discharge lamp as recited in claim 2, wherein said inert gas is pressurized to between about 50 to about 500 Torr.

4. The discharge lamp as recited in claim 1, said arc tube medium further comprises a gettering agent.

5. The discharge lamp as recited in claim 6, wherein said gettering agent comprises indium, zinc or scandium metal chips.

6. The discharge lamp as recited in claim 1, wherein the ratio of said length to said diameter is about 5:1 to about 15:1.

7. The discharge lamp as recited in claim 1, wherein said arc tube comprises of glass selected from the group consisting of fused silica quartz, borated silica and polycrystalline alumina.

* * * * *